US007584870B2

(12) United States Patent
Drennow

(10) Patent No.: US 7,584,870 B2
(45) Date of Patent: Sep. 8, 2009

(54) CONNECTING DEVICE

(75) Inventor: Sten Drennow, Lund (SE)

(73) Assignee: ASEPT International AB, Lund (SE)

( * ) Notice: Subject to any disclaimer, the term of this patent is extended or adjusted under 35 U.S.C. 154(b) by 677 days.

(21) Appl. No.: 10/532,000

(22) PCT Filed: Oct. 22, 2003

(86) PCT No.: PCT/SE03/01628

§ 371 (c)(1),
(2), (4) Date: Apr. 20, 2005

(87) PCT Pub. No.: WO2004/037667

PCT Pub. Date: May 6, 2004

(65) Prior Publication Data

US 2006/0151527 A1 Jul. 13, 2006

(30) Foreign Application Priority Data

Oct. 24, 2002 (SE) ..... 0203129

(51) Int. Cl.
*B67D 5/00* (2006.01)
*B65D 35/56* (2006.01)

(52) U.S. Cl. ..... 222/83.5; 222/89; 222/105

(58) Field of Classification Search ..... 222/80, 222/81, 83, 83.5, 87, 88, 89, 90, 107, 105
See application file for complete search history.

(56) References Cited

U.S. PATENT DOCUMENTS 4,150,673 A * 4/1979 Watt ..... 604/408
4,322,019 A * 3/1982 Smith ..... 222/83.5

(Continued)

FOREIGN PATENT DOCUMENTS

SE 445 824 B 7/1986

(Continued)

*Primary Examiner*—Kevin P Shaver
*Assistant Examiner*—Melvin A Cartagena
(74) *Attorney, Agent, or Firm*—Tarolli, Sundheim, Covell & Tummino LLP

(57) ABSTRACT

The present invention relates to a connecting device for connecting discharge devices to packages (3) with liquid products, preferably foodstuff products, for discharging the products from the packages (3). The connecting device includes two connecting members which can be connected to each other, namely a first connecting member (9) which has a hole (11), the hole being closed by means of a closing member (13), and a second connecting member having a tubular member by means of which the closing member (13) can be penetrated for opening the first connecting member (9). The tubular member can be inserted into the hole (11) and pressed onto edge portions (16) of the hole (11) in the first connecting member (9). The hole (11) has four, five or six corners (15) and edge portions (16) which extend between the corners and the tubular member is designed to fit with the hole (11). The edge portions (16 and 18 respectively) of the hole (11) and the tubular member (14) respectively, are concave and arcuate relative to the centre (C1 and C2 respectively) of the hole (11) and the tubular member (14) respectively, and the concave and arcuate edge portions (16 and 18 respectively) of the hole (11) and the tubular member (14) respectively, connect to each other for defining the corners (15 and 17 respectively) of the hole (11) and the tubular member (14) respectively.

9 Claims, 4 Drawing Sheets

U.S. PATENT DOCUMENTS

| | | | | |
|---|---|---|---|---|
| 4,576,313 | A * | 3/1986 | Smith et al. | 222/81 |
| 4,603,793 | A | 8/1986 | Stern | |
| 6,109,315 | A | 8/2000 | Stern | |

FOREIGN PATENT DOCUMENTS

| | | | |
|---|---|---|---|
| SE | 514 699 | C2 | 4/2001 |
| WO | WO-02/26586 | A1 | 4/2002 |

* cited by examiner

CONNECTING DEVICE

FIELD OF THE INVENTION

The present invention relates to a connecting device for connecting discharge devices to packages with liquid products, preferably foodstuff products, for discharging said products from the packages, wherein the packages have walls of synthetic material. The connecting device includes two connecting members which can be connected to each other, namely a first connecting member which is located on a wall of the package and a second connecting member which can be connected to said first connecting member for connecting the discharge device to the package. The first connecting member has a hole or a notch for a hole, said hole being closed by means of a closing member, and the second connecting member has a tubular member by means of which the closing member can be penetrated for opening the first connecting member. The tubular member can be inserted into the hole and pressed onto edge portions of the hole such that the tubular member adheres to said edge portions and the connecting members thereby adhere close to each other. The hole in the first connecting member has four, five or six corners and edge portions which extend between said corners and the tubular member of the second connecting member has a corresponding number of corners and edge portions extending therebetween.

BACKGROUND OF THE INVENTION

It is known at connecting devices with connecting members having holes and tubular connecting members fitting thereto, to design the holes and the tubular members with four, five or six corners. The purpose of designing the holes and the tubular members respectively, in this way is that connection of a tubular member to a hole shall be possible only if the shapes thereof correspond exactly with each other.

However, it has been found that one by means of polygonal tubular members and holes can not entirely exclude misconnections since one by using force during connection can deform the members in which the holes are provided and/or the tubular members such that one thereby obtains an acceptable fit between said members.

Thus, it is possible to closely connect cylindrical connecting members, i.e. tubular members of ordinary shape, to connecting members having holes, wherein the holes are polygonal, so that one moves the cylindrical connecting member into the hole with such a force that the edges thereof are deformed and bent inwards until the hole gets a circular shape into which the tubular member fits.

SUMMARY OF THE INVENTION

The object of the present invention is to eliminate this problem and this is arrived at by providing the initially defined connecting device with the characterizing features of primarily subsequent claim 1.

Since the first connecting member of the connecting device has holes and the second connecting member a tubular member, the edges of which are concave and arcuate and connect to each other, it is in practice impossible to deform the edges e.g. by means of cylindrical connecting members, which means that cylindrical connecting members are not connected to the connecting member with a hole. By designing the edges of the hole and the tubular member respectively, in said manner, it is further achieved that the members with holes and the tubular members will fit firmly together but still be easily releaseable from each other by relative rotation.

BRIEF DESCRIPTION OF THE DRAWINGS

The invention will be further described below with reference to the accompanying drawings, in which.

DESCRIPTION OF EXAMPLE EMBODIMENTS

Figure 1:
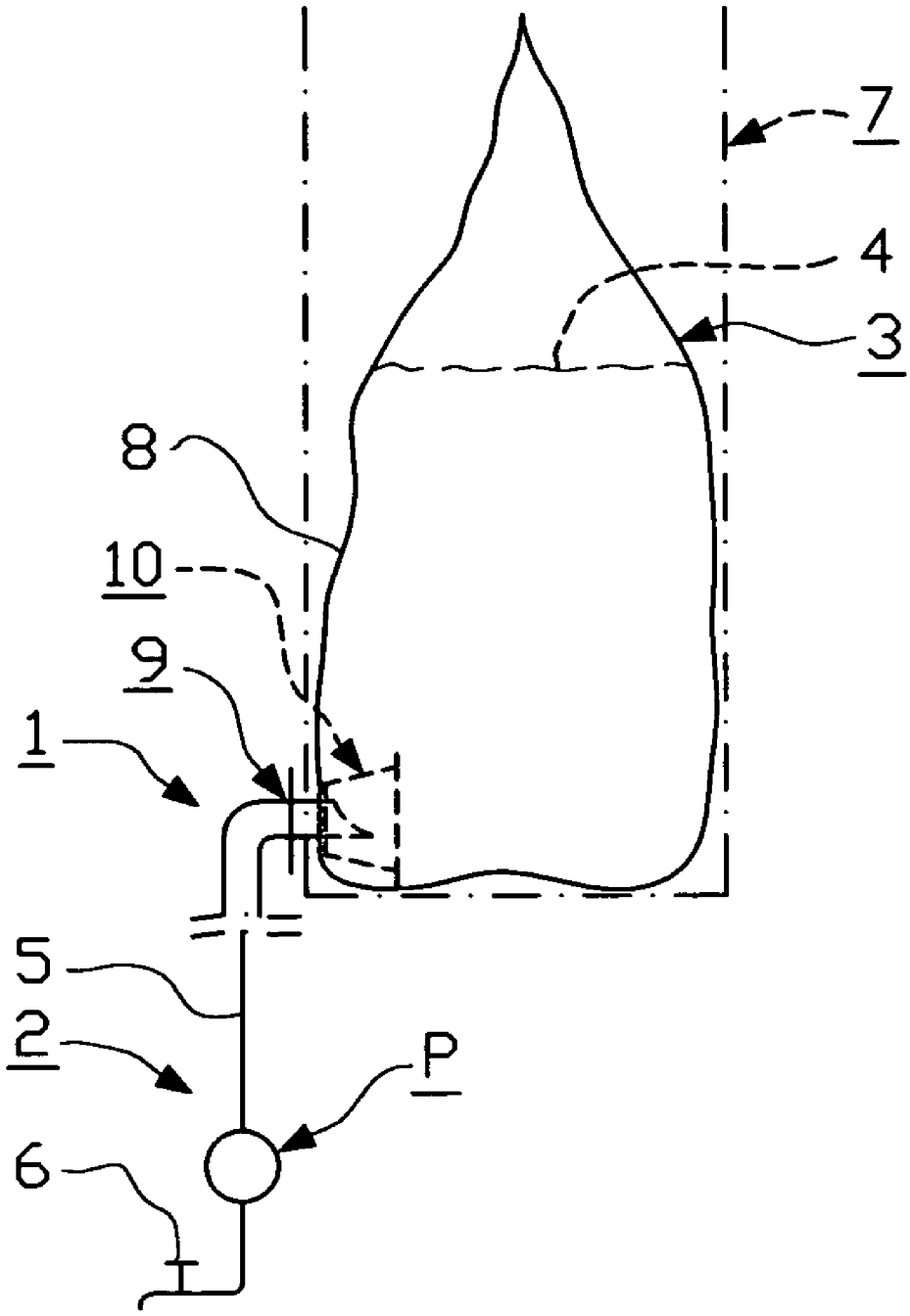
FIG. 1 is a schematic side view showing a package and a connecting device according to the invention provided thereon.

The connecting devices 1 illustrated in the drawings 5 are adapted for connection of discharge devices 2 to packages 3 with liquid products 4, e.g. foodstuff products, for discharging said products 4 from the packages 3.

The discharge devices 2 may be of different types. They may e.g. consist of or include a hose 5 or similar with a tap 6 and by opening the tap 6 the product 4 can flow out of the package 3 and out through the hose 5 by self-flow. The discharge devices 2 may in another embodiment include a pump P for pumping the product 4 out of the package 3 by generating a negative pressure therein.

The package 3 has walls 8 of synthetic material and it consists preferably completely of synthetic material. The material is preferably flexible and the package 3 may be designed as a plastic bag. The package 3 can preferably be placed in a container 7.

The connecting device 1 has two connecting members 9 and 10 which can be connected to each other, namely a first connecting member 9 which is provided on a first wall portion 8*a* of a wall 8 of the package 3 and a second connecting member 10 which can be connected to the first connecting member 9 for connecting the discharge device 2 to the package 3.

The first connecting member 9 has a hole 11 or a notch for a hole 11. The hole 11 is closed by means of a closing member 13. By means of a tubular member 14 of the second connecting member 10, said closing member 13 can be penetrated and then, said tubular member 14 is insertable into the hole 11 until the connecting members 9, 10 are closely attached to each other.

Figure 4:
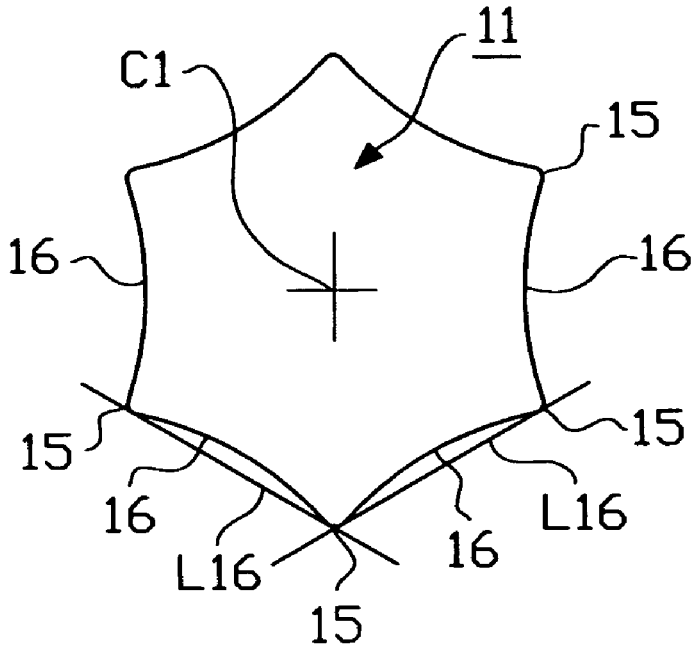
FIG. 4 illustrates with a plan view an inner shape of a hole in the first connecting member according to FIG. 2.
Figure 5:
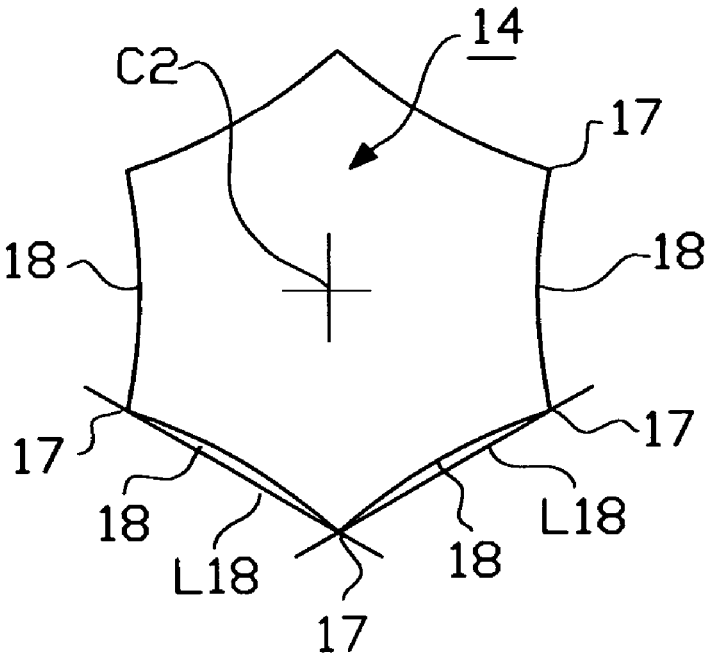
FIG. 5 is a plan view of an outer shape of a tubular member of the second connecting member according to FIG. 3.

In the embodiment shown, the hole 11 has six corners 15, but it may alternatively have four or five corners 15. The hole 11 has edge portions 16 which extend between adjacent corners (see FIG. 4). In order to fit into such a hole 11 with six corners 15, the tubular member 14 also has six corners 17 (or four or five corners if the hole 11 has this number of holes) and edge portions 18 between these corners 17 (see FIG. 5).

The edge portions 16 of the hole 11 are inwardly directed and/or include members or portions which are directed inwards towards the centre C1 of the hole 11 relative to straight geometric lines L16 which connect adjacent corners 15 between the edge portions 16 to each other. The edge portions 18 of the tubular member 14 are in a corresponding manner directed inwards and/or include members or portions directed inwards towards the centre C2 of the tubular member 14 relative to straight geometric lines L18 which connect adjacent corners 17 between the edge portions 18 to each other.

In the embodiment shown, the edge portions 16 and 18 respectively, of the hole 11 and the tubular member 14 respectively, define concave arcs relative to the centre C1 and C2 respectively, of said hole 11 and said tubular member 14 respectively, and all these arcs may be uniform.

The inwardly directed edge portions 16, 18 may however be designed in other ways than concave arcs and they need not be uniform between all corners.

The first connecting member 9 may be provided in such a definite way on the package 3 that the edge portion 16 of its hole 11 get a predetermined orientation relative to the package 3.

Figure 2:
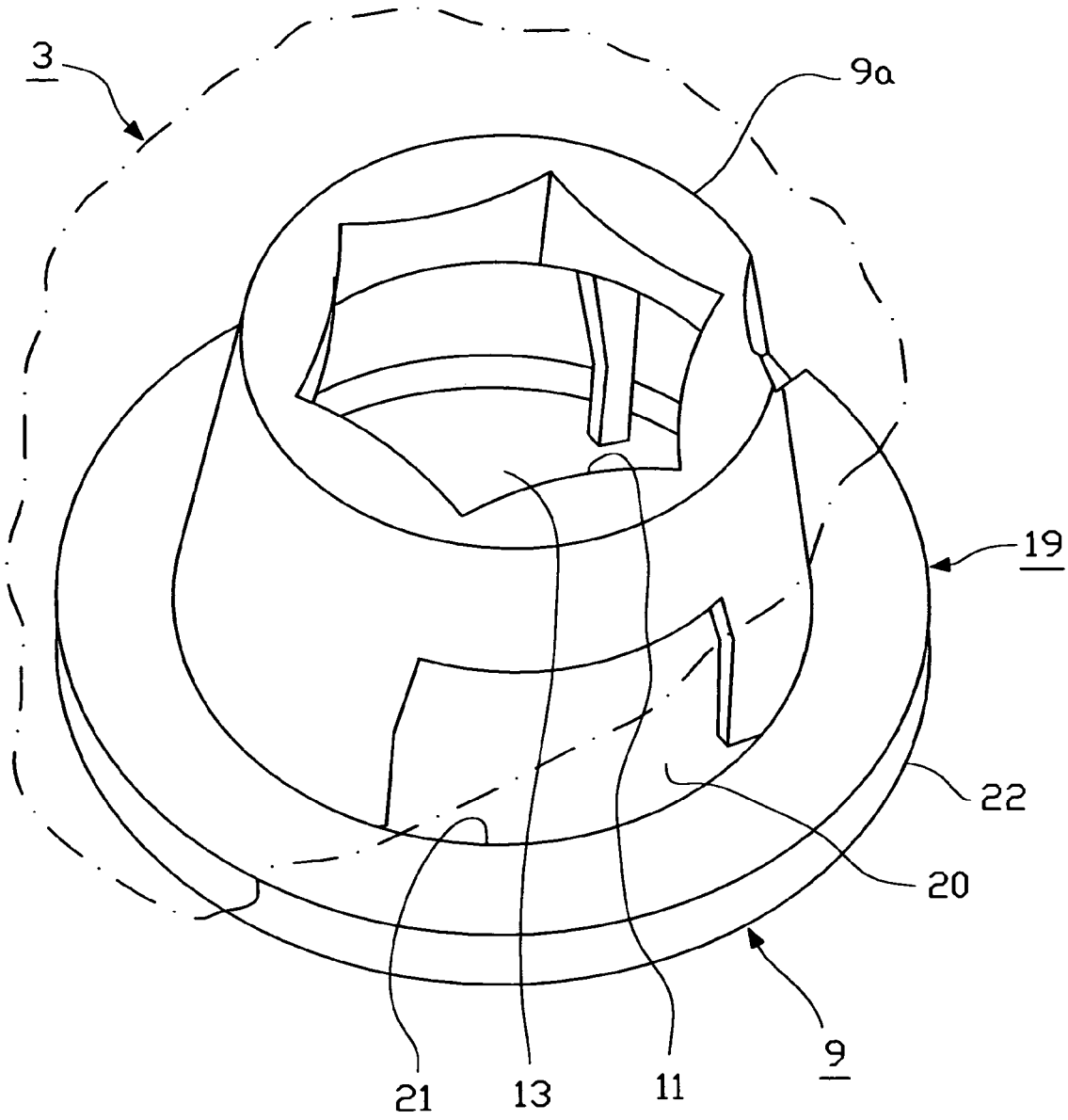
FIG. 2 is a perspective view of a first connecting member of the connecting device according to FIG. 1.
Figure 3:
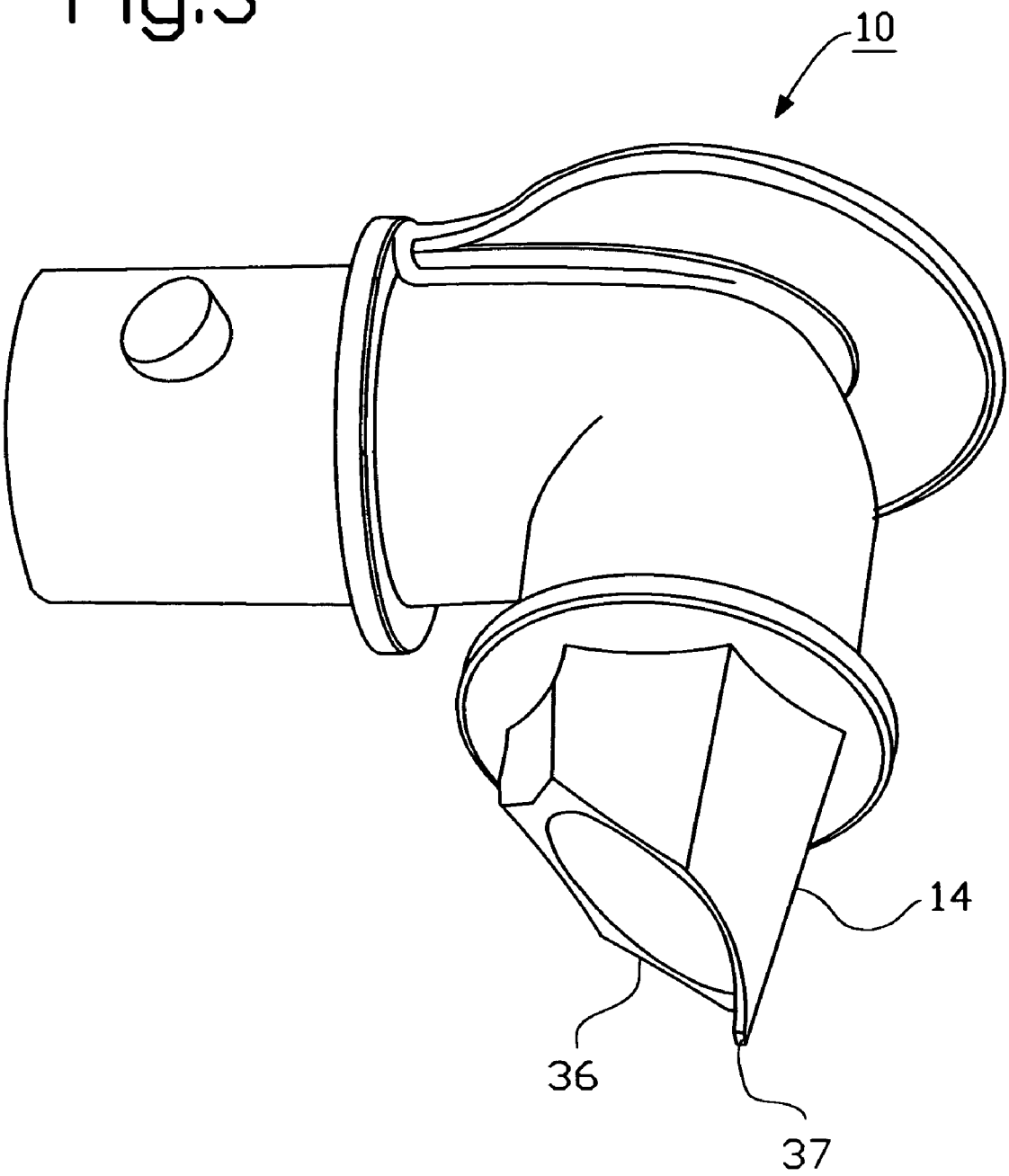
FIG. 3 is a perspective view of a second connecting member of the connecting device of FIG. 1.

In the embodiment of the connecting device 1 illustrated in FIGS. 1-3, the first connecting member 9 is located inside the package 3. A member or portion 9*a* of the first connecting member 9, provided with the hole 11, is located, preferably welded to the inside of a first wall portion 8*a* of the wall 8. An unbroken part of said wall portion 8*a* define the closing member 13 closing the hole 11.

The first connecting member 9 illustrated in FIGS. 1-3 further includes a spacer 19 which is provided to hold such wall portions of the walls 8 of the package 3, e.g. second wall portions 8*b* located right opposite to the wall portions 8*a*, at a distance from the hole 11 such that these wall portions can not be located so close to the hole 11 that they when emptying the package 3 can prevent or obstruct the product 4 from flowing to the hole 11 and out therethrough. The spacer 19 may have one or more lateral openings 20 and an end opening 21 in an inner part 22 thereof.

It should be mentioned that connecting members 9 of said type and their functions have been known for a long time—see e.g. U.S. Pat. No. 4,603,793, FIGS. 3 and 4.

The tubular member 14 may have an end edge 36 which is inclined relative to the geometric axial centre line of the tubular member 14. This inclined end edge 36 forms a tip or point 37 which is eccentric relative to the centre line.

The first connecting member 9 may instead of the hole 11 have notches therefor and the closing member 13 may in such an embodiment be provided to fill the space between said notches and it may be penetrated by means of the tubular member 14. In such an embodiment, the first connecting member 9 and the closing member 13 may be designed as a unit or the closing member 13 may be attached to the first connecting member 9 and cover the notch.

The invention is not limited to the embodiments described above and shown in the drawings, but may vary within the scope of the following claims. It should e.g. be mentioned that the package 3 may contain other liquid or semi-liquid products than foodstuff, such as e.g. pharmaceutical products or glue products.

The invention claimed is:

1. Connecting device for connecting discharge devices (2) to packages (3) with liquid products (4), preferably foodstuff products, for discharging said products (4) from the packages (3), wherein the packages (3) have walls (8) of synthetic material, wherein the connecting device (1) includes two connecting members (9, 10) which can be connected to each other, namely a first connecting member (9) which is located on a wall (8) of the package (3) and a second connecting member (10) which can be connected to said first connecting member (9) for connecting the discharge device (2) to the package (3), wherein the first connecting member (9) has a hole (11) or a notch for a hole (11), said hole (11) being closed by means of a closing member (13), wherein the second connecting member (10) has a tubular member (14) by means of which the closing member (13) can be penetrated for opening the first connecting member (9), wherein the tubular member (14) can be inserted into the hole (11) and pressed onto edge portions (16) of the hole (11) such that the tubular member (14) adheres to said edge portions (16) and the connecting members (9, 10) adhere close to each other, wherein the hole (11) in the first connecting member (9) has four, five or six corners (15) and edge portions (16) which extend between said corners (15), and wherein the tubular member (14) of the second connecting member (10) has a corresponding number of corners (17) and edge portions (18) extending therebetween, wherein the edge portions (16 and 18 respectively) of the hole (11) and the tubular member (14) respectively, are concave and arcuate relative to the centre (C1 and C2 respectively) of said hole (11) and said tubular member (14) respectively, and that the concave and arcuate edge portions (16 and 18 respectively) of the hole (11) and the tubular member (14) respectively, connect to each other for defining the corners (15 and 17 respectively) of said hole (11) and said tubular member (14) respectively.

2. Connecting device according to claim 1, wherein the edge portions (16 and 18 respectively) of the hole (11) and the tubular member (14) respectively, are uniform.

3. Connecting device according to claim 1, wherein the first connecting member (9) is provided on the package (3) such that the edge portions (16) of its hole (11) has a certain orientation relative to the package (3).

4. Connecting device according to claim 1, wherein the first connecting member (9) is provided inside the package (3) and located on the inner side of an unbroken part of a wall portion (8*a*) of the package (3) such that said unbroken part defines the closing member (13) closing the hole (11) in the first connecting member (9).

5. Connecting device according to claim 4, wherein the first connecting member (9) has a spacer (19) which is provided inside the package (3) such that it during emptying of said package (3) keeps wall portions (8*b*) thereof at a distance from the hole (11).

6. Connecting device according to claim 1, wherein the first and the second connecting member (9, 10) respectively, consists of elastic material.

7. Connecting device according to claim 1, wherein the first and second connecting member (9, 10) consist of synthetic material.

8. Connecting device according to claim 1, wherein the package (3) consists of flexible material and is designed as a plastic bag.

9. A connecting device for connecting discharge devices (2) to packages (3) with liquid products (4) to discharge the products (4) from the packages (3), the packages (3) having walls (8) of synthetic material, the connecting device comprising:

a first connecting member (9) located on a wall (8) of the package (3), the first connecting member (9) having a hole (11) or a notch for a hole (11) closed by a closing member (13), the hole (11) having at least four corners (15) and edge portions (16) which extend between the corners (15), the edge portions (16) being concave and arcuate relative to the center (01) of the hole (11); and a second connecting member (10) which can be connected to the first connecting member (9) for connecting the discharge device (2) to the package (3), the second connecting member (10) having a tubular member (14) for penetrating the closing member (13) to open the first connecting member (9), the tubular member (14) having a number of corners (17) and edge portions (18) extending therebetween that correspond with the number of corners (15) and edge portions (16) of the hole (11) of the first connecting member (9), the edge portions (18) of the tubular member (14) being concave and arcuate relative to the center (C2) of the tubular member (14), the tubular member (14) being inserted into the hole (11) and pressed onto the edge portions (16) of the hole (11).

* * * * *

UNITED STATES PATENT AND TRADEMARK OFFICE

CERTIFICATE OF CORRECTION

PATENT NO. : 7,584,870 B2
APPLICATION NO. : 10/532000
DATED : September 8, 2009
INVENTOR(S) : Sten Drennow It is certified that error appears in the above-identified patent and that said Letters Patent is hereby corrected as shown below:

Column 4, line 67, after "center" delete "(01)" and insert --(C1)--

Signed and Sealed this

Twenty-fourth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,584,870 B2
APPLICATION NO. : 10/532000
DATED : September 8, 2009
INVENTOR(S) : Sten Drennow It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1174 days.

Signed and Sealed this

Fourteenth Day of September, 2010

David J. Kappos

David J. Kappos
*Director of the United States Patent and Trademark Office*